US008630563B2

(12) United States Patent
Nakamura

(10) Patent No.: US 8,630,563 B2
(45) Date of Patent: Jan. 14, 2014

(54) MOUNTING STRUCTURE AND IMAGE FORMING APPARATUS

(75) Inventor: Ginga Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 226 days.

(21) Appl. No.: 13/180,694

(22) Filed: Jul. 12, 2011

(65) Prior Publication Data

US 2012/0027460 A1 Feb. 2, 2012

(30) Foreign Application Priority Data

Jul. 28, 2010 (JP) ..... 2010-169153

(51) Int. Cl.
*G03G 15/00* (2006.01)
*G03G 15/08* (2006.01)

(52) U.S. Cl.
USPC ..... 399/109; 399/121

(58) Field of Classification Search
USPC ..... 399/109, 110, 121
See application file for complete search history.

(56) References Cited

FOREIGN PATENT DOCUMENTS

| | | | |
|---|---|---|---|
| JP | 03-071693 A | | 7/1991 |
| JP | 03282575 A | * | 12/1991 |
| JP | 06-118773 | | 4/1994 |
| JP | 2009-063661 A | | 3/2009 |

* cited by examiner

*Primary Examiner* — David Gray
*Assistant Examiner* — Erika J Villaluna
(74) *Attorney, Agent, or Firm* — Renner, Otto, Boisselle & Sklar, LLP

(57) ABSTRACT

A mounting structure includes a supporting member and an engagement member. The supporting member includes a first engaging section at one edge portion and a second engaging section at the other edge portion, and supports or positions an object to support. The engagement member includes a first engagement section capable of engaging with the first engaging section and a second engagement section capable of engaging with the second engaging section, and is a member for holding the supporting member with the supporting member being mounted onto the engagement member. Also, the supporting member supports or positions the object to support with the first engaging section and the second engaging section respectively engaging with the first engagement section and the second engagement section. The first engaging section has a higher rigidity than the first engagement section. The second engaging section has a higher rigidity than the second engagement section.

6 Claims, 8 Drawing Sheets

MOUNTING STRUCTURE AND IMAGE FORMING APPARATUS

CROSS REFERENCE

This Nonprovisional application claims priority under 35 U.S.C. §119(a) on Patent Application No. 2010-169153 filed in Japan on Jul. 28, 2010, the entire contents of which are hereby incorporated by reference.

BACKGROUND OF THE INVENTION

The present invention relates to a mounting structure for supporting or positioning a predetermined object to support and to an image forming apparatus provided therewith.

A snap-fit coupling structure as an example of a mounting structure is used in assembly of components and so forth in many fields due to its simplicity in configuration and assembling. Many of these snap-fit coupling structures are configured of a claw section of one member that is a claw-shaped coupling section harnessing an elasticity of a material, and an engaging section of the other member that engages with the claw section.

In recent years, out of a rising awareness about environmental issues, it is required to design a product beforehand so that it is made up in such a manner as to be adapted for recycling. From the viewpoint of recycling, it is desirable that a snap-fit coupling structure be composed of a single resin material without using a metallic part or a metal insert as much as possible.

Conventionally, a snap-fit coupling structure of a component made of resin has mostly been applied to a member of a relatively small size, to a location a load does not act on and so forth (for example, refer to Japanese Utility Model Unexamined Publication No. 03-071693 bulletin).

While a changeover to resin (replacing a material with resin) has progressed in the snap-fit coupling structure as described above, an embodiment of its application has emerged in which a relatively weighty functional unit or the like is supported and positioned inside an apparatus. Therefore, in order to secure the strength of a coupling section between a supporting member and an engagement member to engage with the supporting member in a snap-fit coupling structure, a claw shape is required that is not only of a greater size as compared with a conventional product but also hard to deform in assembling.

However, with a snap-fit coupling structure comprising a claw shape that is adapted for the above described requirements, a problem arises that workability in assembling is lost due to the claw shape.

Thus, in view of the problem as described above, the present invention is directed to providing a mounting structure that is capable of supporting or positioning a weighty object and does not cause loss of workability in assembling.

SUMMARY OF THE INVENTION

A mounting structure of the present invention comprises a supporting member and an engagement member. The supporting member has a first engaging section at one edge portion and a second engaging section at the other edge portion, and supports or positions an object to support. The engagement member has a first engagement section capable of engaging with the first engaging section and a second engagement section capable of engaging with the second engaging section, and is a member for holding a supporting member with the supporting member being mounted onto the engagement member.

Also, the supporting member supports or positions the object to support with the first engaging section and the second engaging section respectively engaging with the first engagement section and the second engagement section. The first engaging section has a higher rigidity than the first engagement section. The second engaging section has a higher rigidity than the second engagement section.

In a first step, the first engaging section engages with the first engagement section when the first engagement section is pressed by the first engaging section; in a second step, the second engaging section engages with the second engagement section when the second engagement section is pressed by the second engaging section; and through the first step and the second step, the supporting member is mounted onto the engagement member.

In this configuration, an elastic force of the first engaging section of the supporting member is stronger than an elastic force of the first engagement section of the engagement member, and an elastic force of the second engaging section of the supporting member is stronger than an elastic force of the second engagement section of the engagement member. Accordingly, since the first engagement section and the second engagement section can be respectively expanded by the first engaging section and the second engaging section when the supporting member is mounted onto the engagement member, the supporting member can engage with the engagement member through a method that is easy to follow to put them together.

Also, in a state in which the supporting member is mounted onto the engagement member, because the first engaging section and the second engaging section of the supporting member are respectively clamped by the first engagement section and the second engagement section of the engagement member, the supporting member is capable of stably supporting or positioning a predetermined weighty object.

Thus, the mounting structure of the present invention allows to support or position a weighty object; moreover, it does not cause loss of workability in assembling.

BRIEF DESCRIPTION OF THE DRAWINGS

FIG. 3A is a side view showing a configuration of a supporting member, whereas

FIG. 7A is a perspective view showing a state in which a first engaging section is in engagement with a first engagement section, whereas

FIG. 8A is a perspective view showing a state in which a second engaging section is brought into engagement with a second engagement section after the first engaging section having been brought into engagement with the first engagement section, whereas

DETAILED DESCRIPTION OF THE INVENTION

Figure 1:
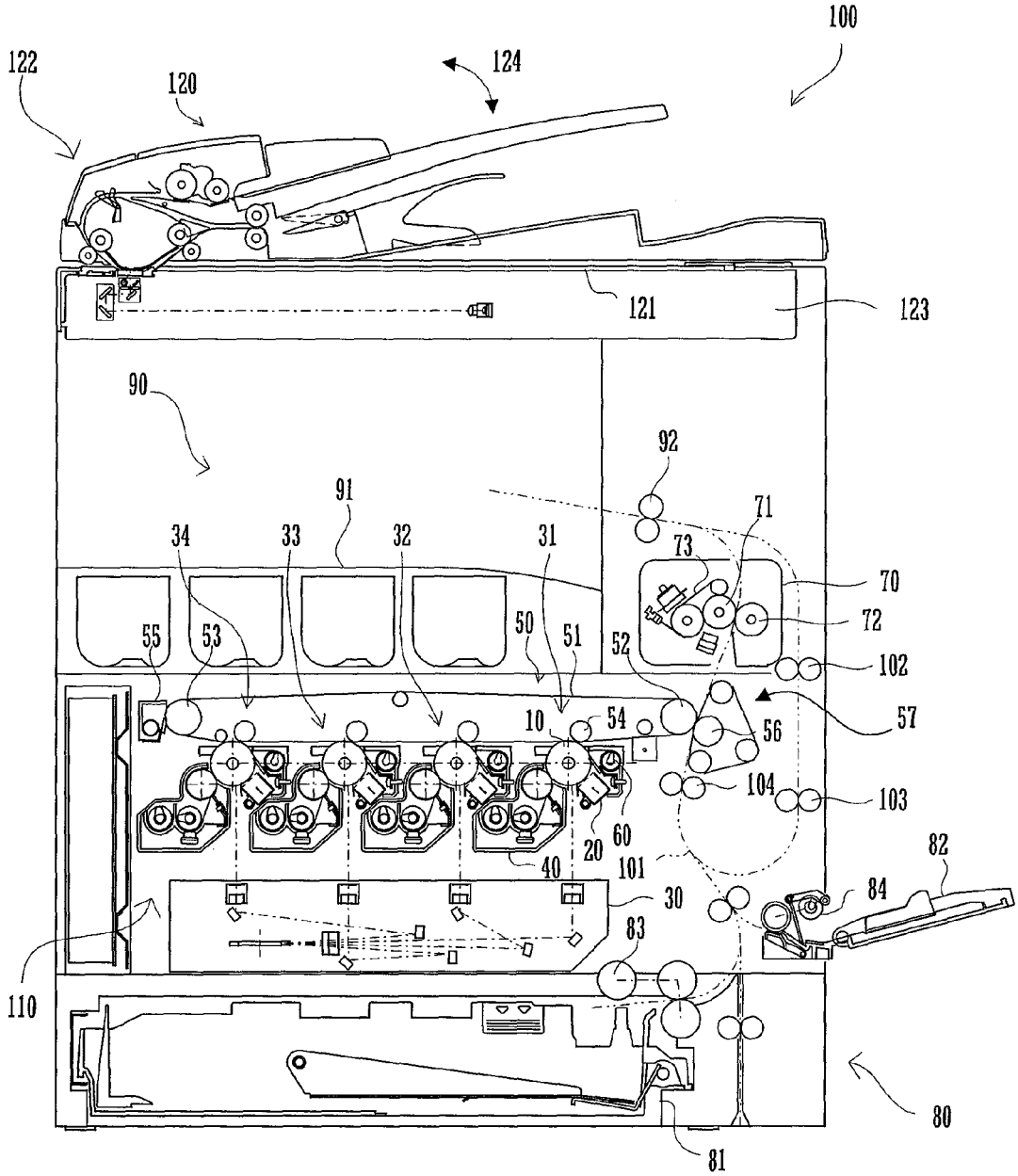
FIG. 1 is a drawing showing a configuration of an image forming apparatus provided with a mounting structure according to an embodiment of the present invention.

A mounting structure according to an embodiment of the present invention is explained below in detail referring to the drawings.

FIG. 1 is a drawing showing a configuration of an image forming apparatus 100 provided with a mounting structure 200 according to an embodiment of the present invention.

The image forming apparatus 100 is one that forms a multicolored or a monochromatic image onto a predetermined sheet (recording paper) based on image data that have been transmitted from outside. The image forming apparatus 100 comprises a document processing unit 120, a paper feeding section 80, an image forming section 110 and a paper discharge section 90.

The document processing unit 120 includes a document loading table 121, a document conveying equipment 122 and a document reading section 123. The document loading table 121 is made of a transparent glass, and is configured such that document can be placed thereon. The document conveying equipment 122 conveys, piece by piece, documents that are placed on a document load tray.

The document conveying equipment 122 is also configured so as to be swung freely in the direction of an arrow 124, and thereby enables a user to place the document on the document loading table 121 when upside of the document loading table 121 is open. The document reading section 123 reads a document being conveyed by the document conveying equipment 122, or a document placed on the document loading table 121.

The paper supply section 80 is provided with a paper feed cassette 81, a manual paper feed cassette 82, a pickup roller 83 and a pickup roller 84. The paper feed cassette 81 is a tray to store sheets of a standard size. The manual paper feed cassette 82 is a tray on which to place sheet(s) of a non-standard size. The pickup roller 83 is installed in close vicinity to an edge of the paper feed cassette 81, picks up the sheets from the paper feed cassette 81 piece by piece, and supplies it to the paper conveying path 101. Similarly, the pickup roller 84 is installed in close vicinity to an edge of the manual paper feed cassette 82, picks up the sheets from the manual paper feed cassette 82 piece by piece, and supplies it to the paper conveying path 101.

The image forming section 110 comprises image forming stations 31, 32, 33, 34, an exposure unit 30, an intermediate transfer belt unit 50 and a fuser unit 70. The image forming stations 31, 32, 33, 34 respectively include a photoreceptor drum 10, an electrostatic charger 20, a developing device 40 and a cleaner unit 60, thereby being adapted to color images that use respective colors of black (K), cyan (C), magenta (M) and yellow (Y). On this embodiment, the image forming station 31 is explained.

The photoreceptor drum 10 rotates in image forming, and is the one to bear a developer image. Around the photoreceptor drum 10 are disposed the electrostatic charger 20, the exposure unit 30, the developing device 40, the intermediate transfer belt unit 50 and the cleaner unit 60 in this order from upstream side in its rotational direction. The fuser unit 70 is located most downstream in the image forming section 110 on the conveying path 101.

The electrostatic charger 20 is a charging means to charge a surface of the photoreceptor drum 10 uniformly at a predetermined electrostatic potential; and other than the charger type as shown in FIG. 1, an electrostatic charger of a contact type such as roller type or brush type is occasionally used.

The exposure unit 30, by exposing, depending on image data inputted, the photoreceptor drum 10 that is charged with electricity, has a function to form on the surface of the photoreceptor drum 10 an electrostatic latent image corresponding to the image data. The exposure unit 30 is configured as a laser scanning unit (LSU) that includes a laser emitting section, a reflecting mirror and so forth. In the exposure unit 30 are disposed a polygonal mirror that scans a laser beam, and optical components such as lens and mirror to lead the laser beam reflected by the polygonal mirror to the photoreceptor drum 10. For an exposure unit 30, another method using, for example, an EL and/or LED writing head configured in an array-like arrangement of light emitting devices may be employed.

The developing device 40 makes an electrostatic latent image that is formed on the photoreceptor drum 10 a manifest image with a toner.

The intermediate transfer belt unit 50 includes an intermediate transfer belt 51, an intermediate transfer belt drive roller 52, an intermediate transfer belt idle roller 53, an intermediate transfer roller 54 and an intermediate transfer belt cleaning unit 55.

The intermediate transfer belt drive roller 52, the intermediate transfer belt idle roller 53 and the intermediate transfer roller 54 cause the intermediate transfer belt 51 to pass over them in a tensioned condition and to be rotationally driven. Also, the intermediate transfer roller 54 gives a transfer bias to cause a toner image on the photoreceptor drum 10 to be transferred onto the intermediate transfer belt 51.

The intermediate transfer belt 51 is installed so as to be in contact with the photoreceptor drum 10. Then, the intermediate transfer roller 54, by transferring a toner image formed on the photoreceptor drum 10 onto the intermediate transfer belt 51, performs its function to form the toner image on the intermediate transfer belt 51. The intermediate transfer belt 51 is formed into an endless shape, for example, using a film of around 100 μm through 150 μm thick.

Transfer of the toner image from the photoreceptor drum 10 onto the intermediate transfer belt 51 is carried out by the intermediate transfer roller 54 that is in contact with backside of the intermediate transfer belt 51. To the intermediate transfer roller 54, a high-voltage transfer bias (a high voltage of reverse polarity (+) to the electrostatic charge polarity (−) of the toner) is applied in order to transfer the toner image. The intermediate transfer roller 54 is a roller that is formed using a shaft made of metal (e.g., stainless steel) with a diameter of 8 mm through 10 mm as a base material and covering the surface thereof with an electrically-conductive elastomer (e.g., EPDM, urethane foam or the like). The electrically-conductive elastomer makes it possible to apply a high voltage uniformly to the intermediate transfer belt 51. Although roller geometry is used as a transfer electrode in this embodiment, a brush or the like may be used otherwise.

The electrostatic latent image that has been made a manifest image on the photoreceptor drum 10 as described above is superimposed on the intermediate transfer belt 51. The image information that has been superimposed in this manner is transferred onto paper by a secondary transfer belt unit 57 that includes a transfer roller 56 disposed at a position where the paper comes into contact with the intermediate transfer belt 51 as the intermediate transfer belt 51 rotates.

At this time, the intermediate transfer belt 51 and the transfer roller 56 are caused to be pressed with each other with a predetermined nip pressure, and a voltage to cause the toner image to be transferred onto paper (a high voltage of reverse polarity (+) to the electrostatic charge polarity (−) of the toner) is applied to the transfer roller 56. Further, in order to constantly maintain the above described nip pressure, either the transfer roller 56 or the intermediate transfer belt drive roller 52 is chosen to be made of a rigid material (metal, etc.), then to the other is employed a flexible material such as an elastic roller (elastic rubber roller or foam resin roller, etc.).

Also, the intermediate transfer belt cleaning unit 55 is set up so as to remove and collect the toner which adhered to the intermediate transfer belt 51 through its contact with the photoreceptor drum 10 as described above or which remains on the intermediate transfer belt 51 after the transfer has been carried out onto paper by the transfer roller 56. The intermediate transfer belt cleaning unit 55 is equipped with, for instance, a cleaning blade as a cleaning member that is in contact with the intermediate transfer belt 51, and the intermediate transfer belt 51 with which the cleaning blade is in contact is supported from its backside by the intermediate transfer belt idle roller 53.

The cleaner unit 60 removes and collects the toner which remains on the surface of the photoreceptor drum 10 after the development and the image transfer have been carried out.

The fuser unit 70 includes a heating roller 71 and a pressure roller 72; and the heating roller 71 and the pressure roller 72 are configured so as to rotate holding the sheet between them. Also, the heating roller 71 is set to a predetermined fusing temperature by a control section based on the signal from a temperature sensor which is not illustrated, and performs a function of heat fusing on the sheet by means of the thermo-compression bonding of the toner to the sheet in cooperation with the pressure roller 72, through fusing, mixing and pressure-contacting the toner image that has been transferred onto the sheet. An external heating belt 73 is also provided for heating the heating roller 71 from outside.

The paper discharge section 90 includes a copy receiving tray 91 and a paper discharge roller 92. The paper that has passed the fuser unit 70, passing through the paper discharge roller 92, is discharged onto the copy receiving tray 91. The copy receiving tray 91 is a tray to collect the sheet having undergone printing.

Additionally, in the case of duplex printing, rotational direction of the paper discharge roller 92 is reversed when the paper that has undergone a single sided printing and has passed through the fuser unit 70 as described above is held at its rear edge by the paper discharge roller 92, and then the sheet is led to the conveyance rollers 102, 103. Thereafter, having passed through a paper stop roller 104 and then having undergone a printing on its rear face, the sheet is discharged onto the copy receiving tray 91.

Figure 2:
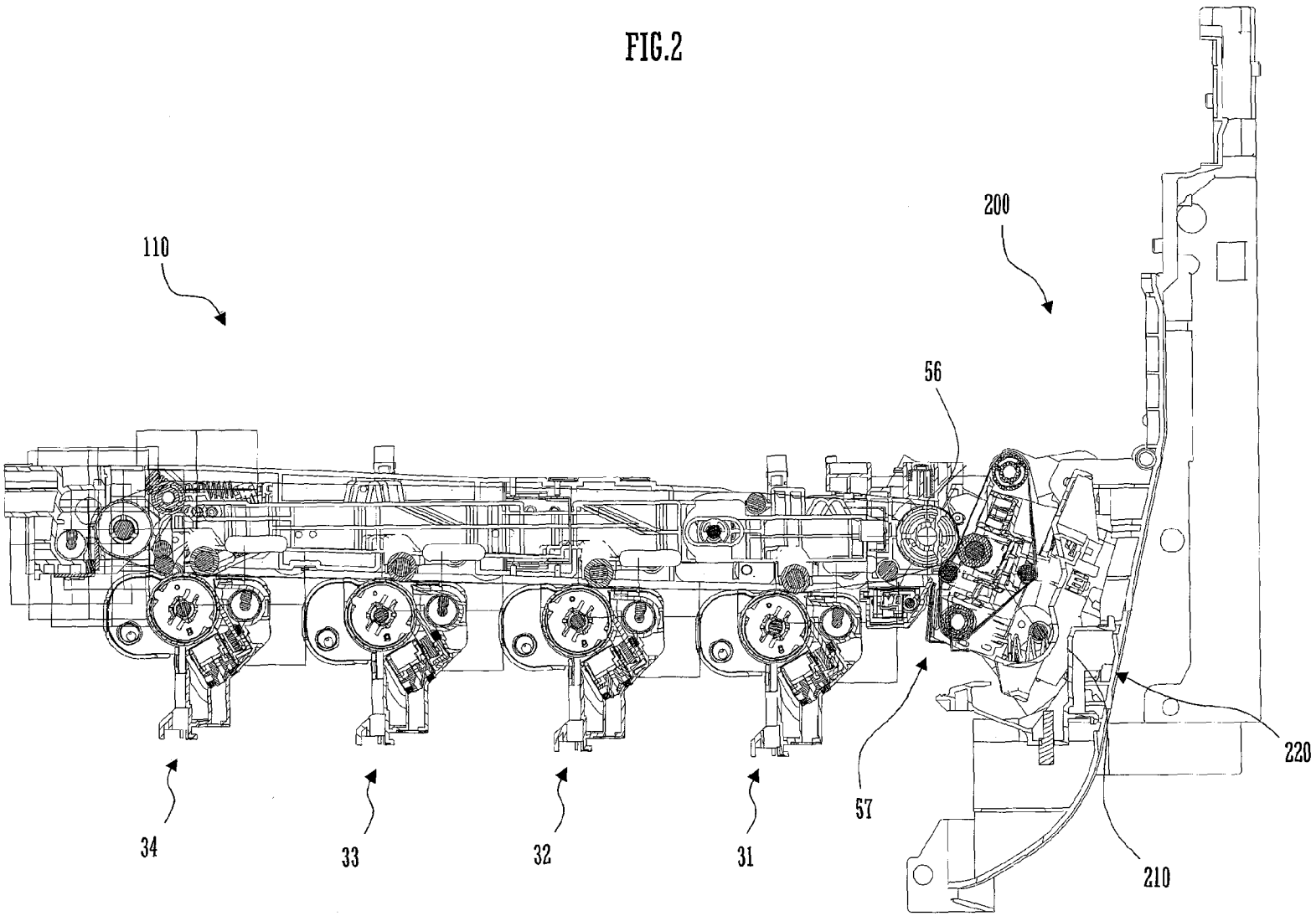
FIG. 2 is a drawing showing a state in which the mounting structure supports a secondary transfer belt unit.

FIG. 2 is a drawing showing a state in which the mounting structure 200 according to the embodiment of the present invention supports the secondary transfer belt unit 57.

Shown in FIG. 2 to illustrate a mode of application of the mounting structure 200 is a state in which the mounting structure 200 is mounted onto a door of the image forming apparatus 100. The mounting structure 200 comprises a supporting member 210 and an engagement member 220.

The supporting member 210 is a member capable of supporting or positioning an object to support in a state in which the supporting member is mounted onto the engagement member. In the embodiment, the supporting member 210 supports the secondary transfer belt unit 57 as an object to support. Further, the supporting member 210 may support or position not only the secondary transfer belt unit 57 but the whole image forming section 110; or it may be the one to support or position another functional unit. The engagement member 220 is a member for engaging with and holding the supporting member 210. A mechanism of engagement between the supporting member 210 and the engagement member 220 will be described below from FIG. 3 onward.

Figure 3A:
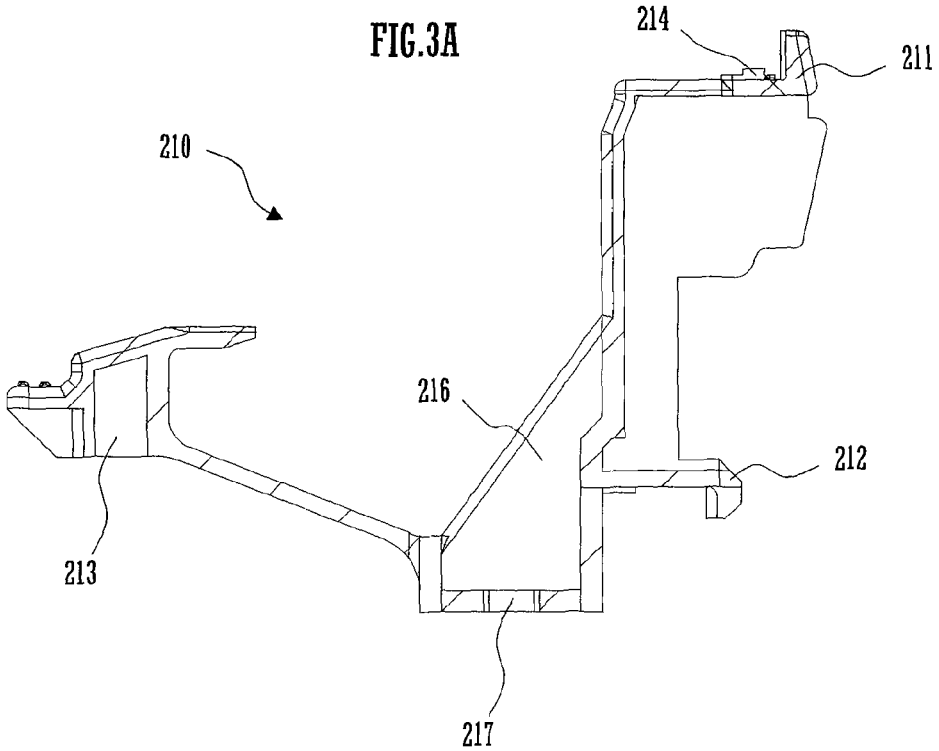
Figure 3B:
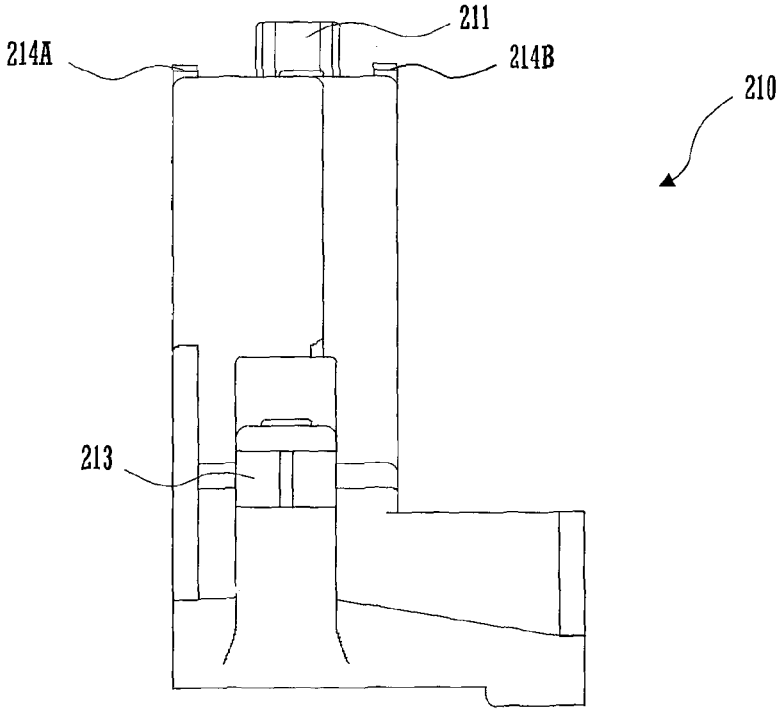
FIG. 3B is a rear view showing the configuration of the supporting member.
Figure 4:
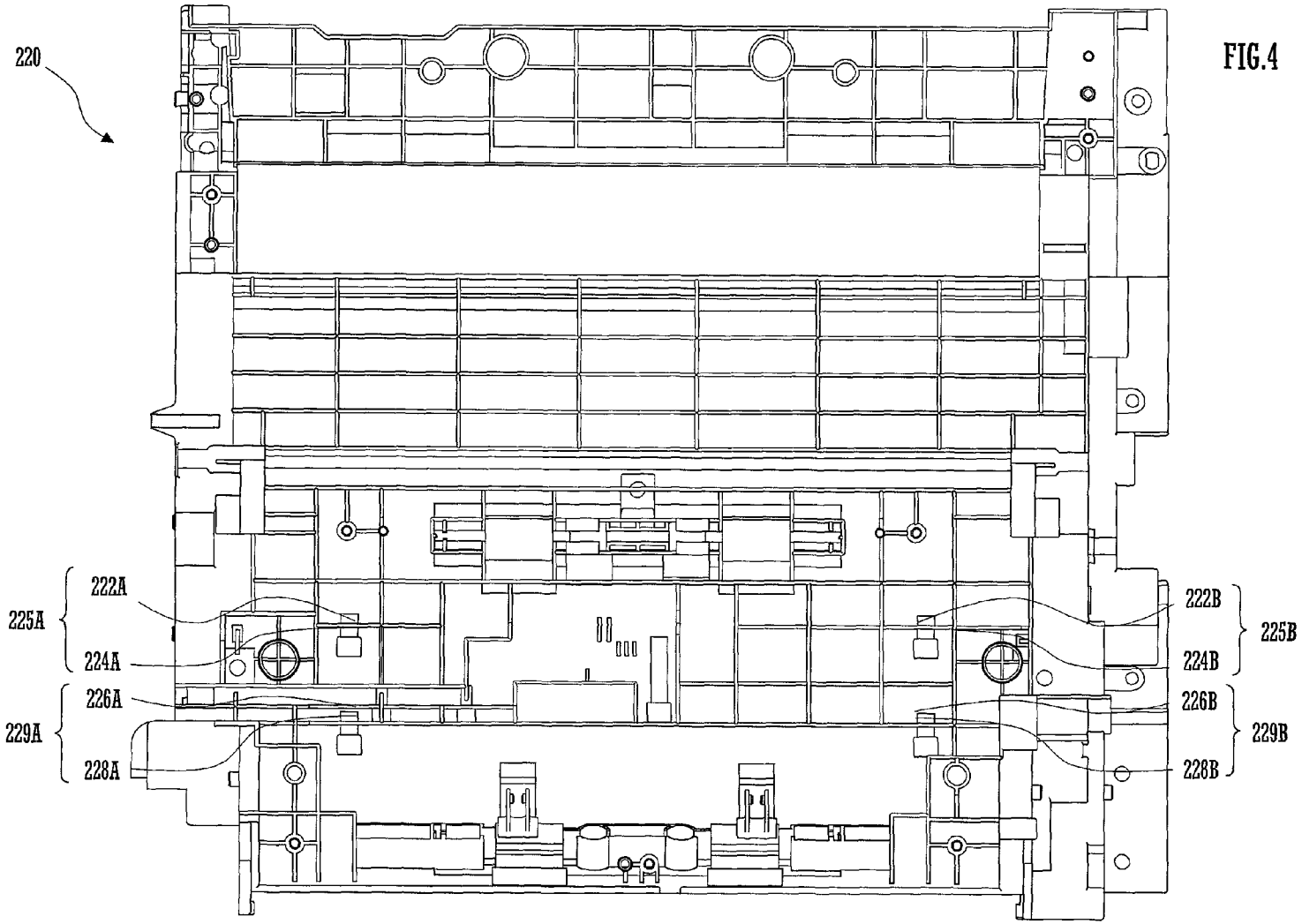
FIG. 4 is a front view of an engagement member.
Figure 5:
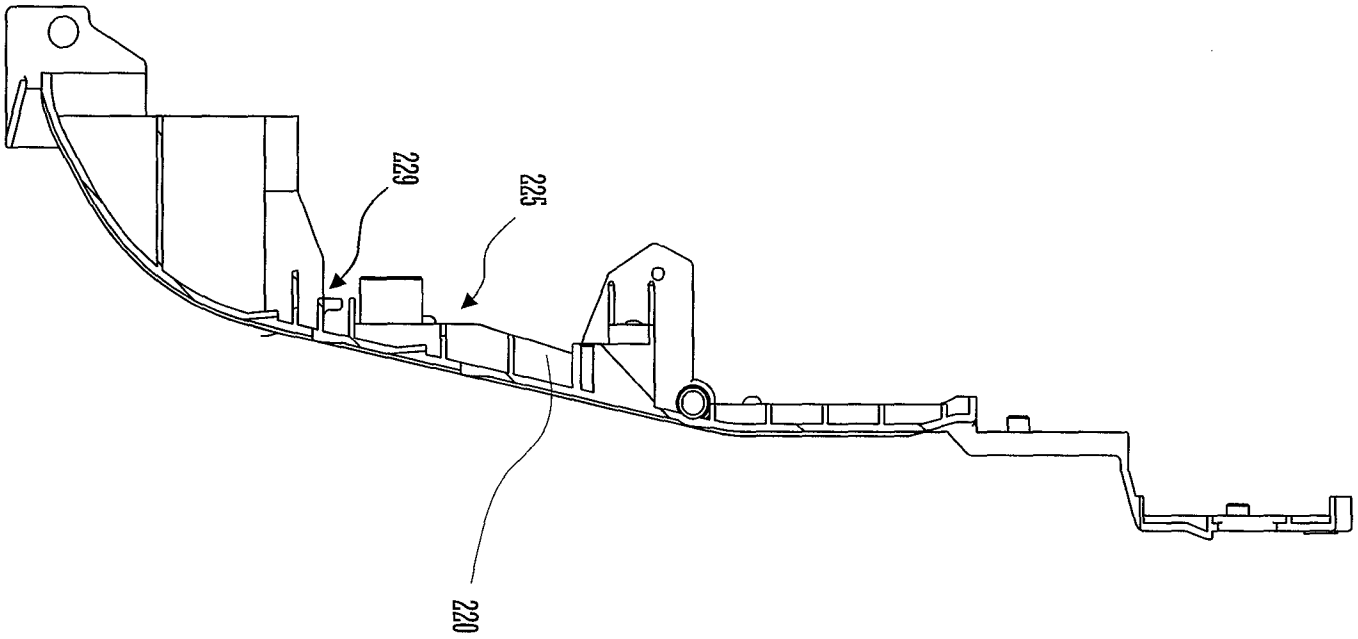
FIG. 5 is a side view of the engagement member.

FIG. 3 is a drawing showing a configuration of the supporting member 210 in the mounting structure 200 according to the embodiment of the present invention. FIG. 3A is a side view of the supporting member 210, and FIG. 3B is a rear view of the supporting member 210. FIG. 4 is a front view of the engagement member 220 in the mounting structure 200 according to the embodiment of the present invention. FIG. 5 is a side view of the engagement member 220 in the mounting structure 200 according to the embodiment of the present invention.

The supporting member 210 comprises a first engaging section 211, a second engaging section 212, a handle section 213, a swing point (shaft) section 214 (214A, 214B), a rib 216 and a bearing hole 217.

The first engaging section 211 is disposed at one edge portion of the supporting member 210. The second engaging section 212 is disposed at the other edge portion of the supporting member 210. The handle section 213 is at right angle to a face of the engagement member 220 in a state in which the supporting member 210 is mounted onto the engagement member 220. The swing point (shaft) section 214 is formed in the first engaging section, and serving as a supporting point for swing of when the supporting member 210 is swung in the second step which is described below. The swing point may be a shaft as shown by Figs. The rib 216 is formed on a rear face side of the supporting member 210. The bearing hole 217 is a hole to set the secondary transfer belt unit 57.

The engagement member 220 comprises a first engagement section 225 (225A, 225B) and a second engagement section 229 (229A, 229B). The first engagement section 225A is configured of a rib 222A and an insertion hole 224A, and the first engagement section 225B is configured of a rib 222B and an insertion hole 224B. Similarly, the second engagement section 229A is configured of an insertion hole 226A and a rib 228A, and the second engagement section 229B is configured of an insertion hole 226B and a rib 228B.

The first engaging section 211 is capable of engaging with the first engagement section 225. The second engaging section 212 is capable of engaging with the second engagement section 229. In the embodiment, the supporting member 210 may achieve an engagement in such a manner that either the first engaging section 211 thereof engages with the first engagement section 225A and the second engaging section 212 thereof engages with the second engagement section 229A, or the first engaging section 211 thereof engages with the first engagement section 225B and the second engaging section 212 thereof engages with the second engagement section 229B. With the supporting member 210 being mounted onto the engagement member 220 in this manner, the supporting member 210 is held by the engagement member 220.

That is, the supporting member 210 in the embodiment is mounted onto only either A side (left side of FIG. 4) or B side (right side of FIG. 4) in the engagement member 220, and does not need to be mounted onto the other side. In other words, the mounting structure 200 of the embodiment provides strength to such an extent that it is capable of supporting or positioning a weighty object with the supporting member 210 being mounted merely onto either A side or B side in the engagement member 220. Of course, it does not matter if the supporting member 210 being mounted onto both A side and B side is used to support or position a weighty object.

The handle section 213 is a portion to grip when a user is working on mounting the supporting member 210 onto the engagement member 220. Since the handle section 213 extends to the rear face side as shown in FIG. 3A, it has such a form that it is easy for a user to mount the supporting member 210 onto the engagement member 220. The swing point (shaft) section 214 is a portion serving as a supporting point for swing for allowing the supporting member 210 to be swung in the state in which the first engaging section 211 is in engagement with the first engagement section 225 when the supporting member 210 is being mounted onto the engagement member 220. A mechanism by which the swing point (shaft) section 214 provides a point of support for swing (a swing shaft) for the supporting member 210 will be described in explanations of FIG. 7 and FIG. 8.

The rib 216 is a portion to reinforce the strength of the supporting member 210. With the rib 216 formed on the supporting member 210, the supporting member 210 can acquire the strength as required in order to support or position a weighty object. The bearing hole 217 is a hole to set a weighty object to the supporting member 210. That is, with part of a weighty object inserted into the bearing hole 217, the supporting member 210 can stably support or position the weighty object. Further, even in the absence of a portion in a weighty object to insert into the bearing hole 217, the supporting member 210 is, with the main body portion thereof, capable of supporting or positioning the weighty object.

Ribs 222A, 222B and insertion holes 224A, 224B in the first engagement section 225 are portions to engage with the first engaging section 211, and insertion holes 226A, 226B and ribs 228A, 228B in the second engagement section 229 are portions to engage with the second engaging section 212. Hereinafter, in the embodiment, it is to be recognized that at least one of the ribs 222A, 222B is denoted by the rib 222, that at least one of the insertion holes 224A, 224B is denoted by the insertion hole 224, that at least one of the insertion holes 226A, 226B is denoted by the insertion hole 226, and that at least one of the ribs 228A, 228B is denoted by the rib 228.

When the first engaging section 211 and the second engaging section 212 are respectively in engagement with the first engagement section 225 and the second engagement section 229, there is no clearance between the first engaging section 211 and the rib 222, nor is there any clearance between the second engaging section 212 and the rib 228. Accordingly, since the supporting member 210 is brought into a state of firmly engaging with the engagement member 220, wobble will not occur even when it supports or positions a weighty object.

Figure 6:
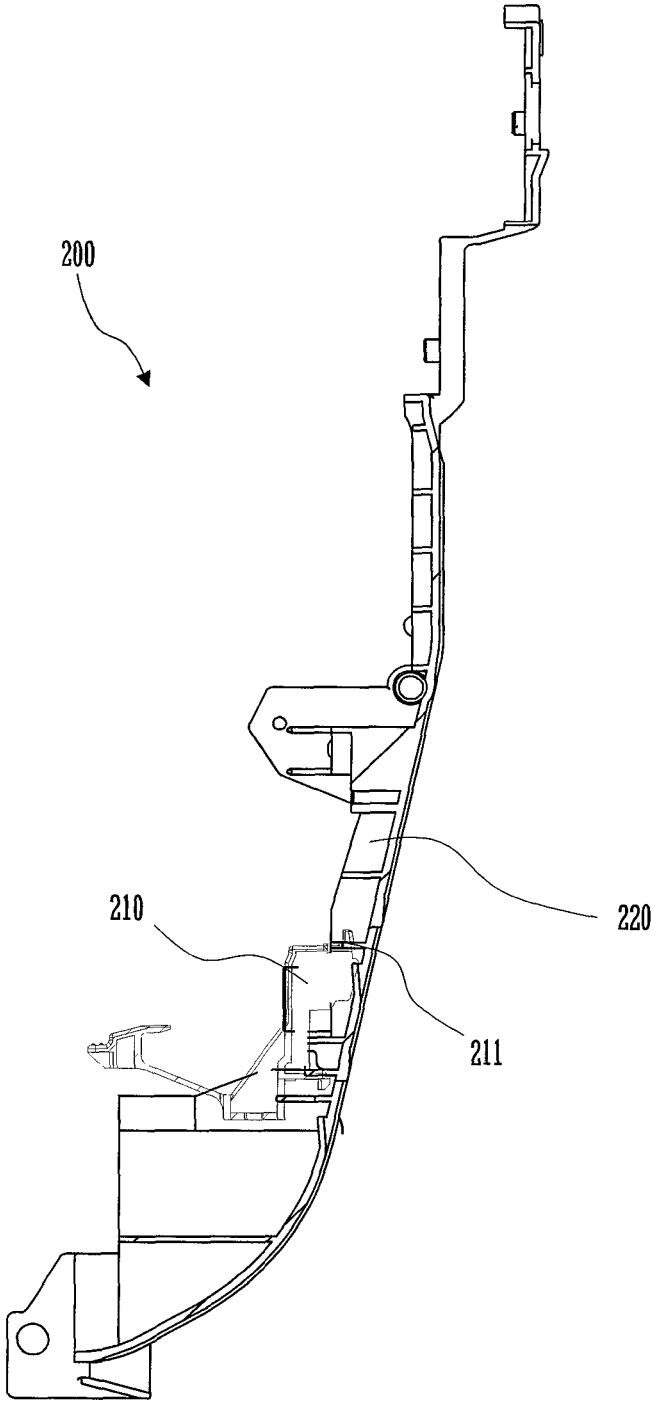
FIG. 6 is a drawing showing a configuration of the mounting structure.

FIG. 6 is a drawing showing a configuration of the mounting structure 200 according to the embodiment of the present invention.

In the embodiment, a sheet conveying path is formed on a face on a side opposite to a side where the supporting member 210 is mounted in the engagement member 220. In the configuration of the embodiment and in the state in which the supporting member 210 is mounted onto the engagement member 220, a free edge of the first engaging section 211 and a free edge of the second engaging section 212 are located on the side of the face on which the supporting member 210 is mounted in the engagement member 220.

With this configuration, since part of the supporting member 210 never protrudes into the conveying path, the supporting member 210 never obstructs conveyance of the sheet even when it is mounted onto the engagement member 220.

FIG. 7 are drawings showing a state in which the first engaging section 211 is in engagement with the first engagement section 225 in the mounting structure 200 according to the embodiment of the present invention. FIG. 8 are drawings showing a state in which the second engaging section 212 is brought into engagement with the second engagement section 229 after the first engaging section 211 having been brought into engagement with the first engagement section 225 in the mounting structure 200 according to the embodiment of the present invention.

Figure 7A:
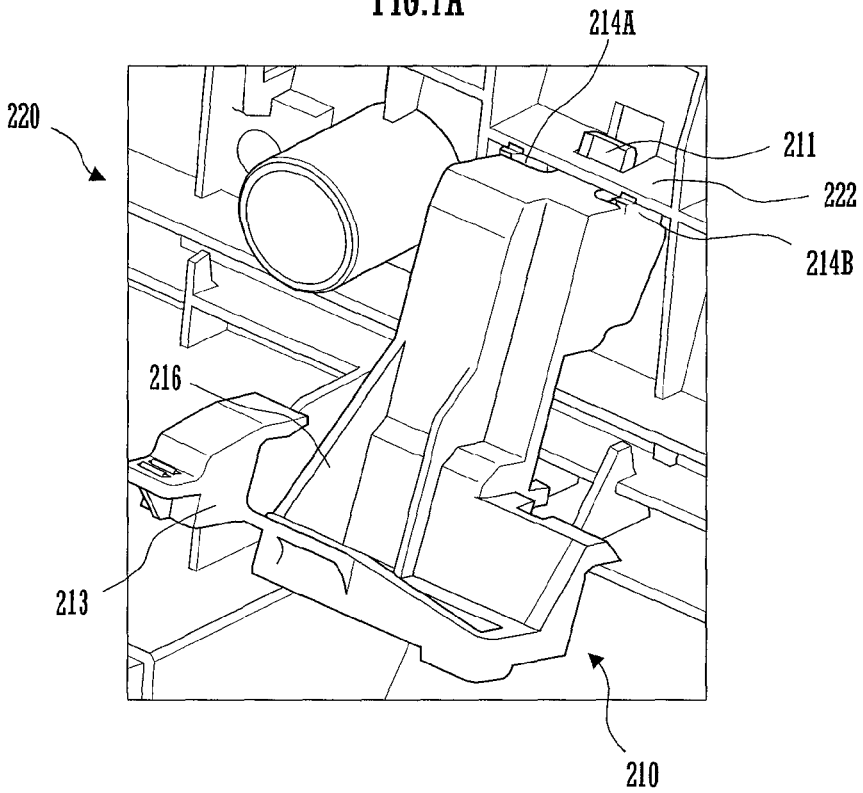
Figure 7B:
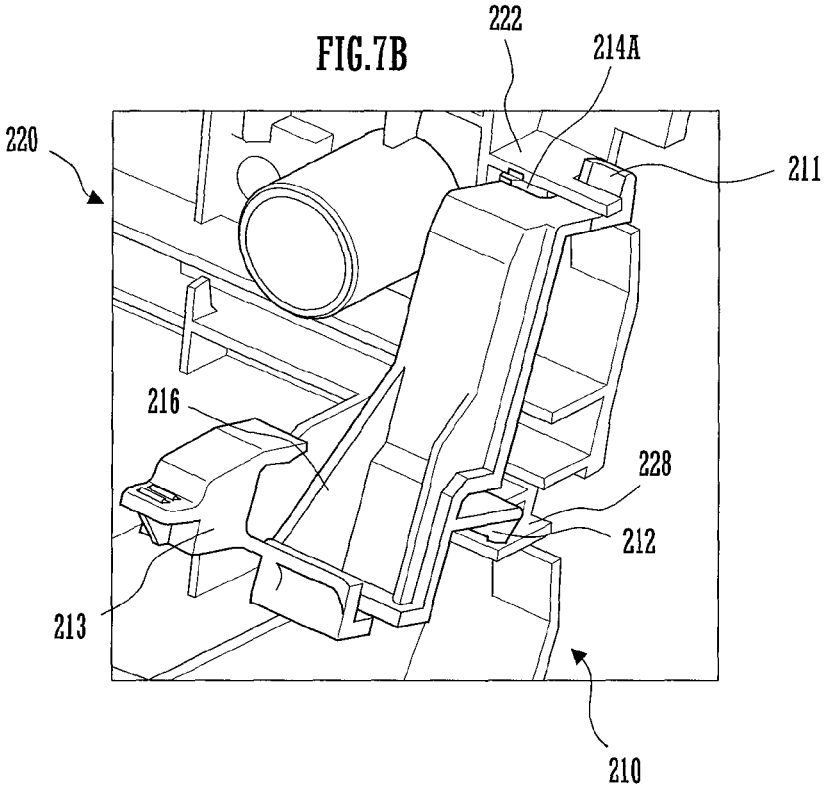
FIG. 7B is a perspective sectional view showing the state in which the first engaging section is in engagement with the first engagement section.
Figure 8A:
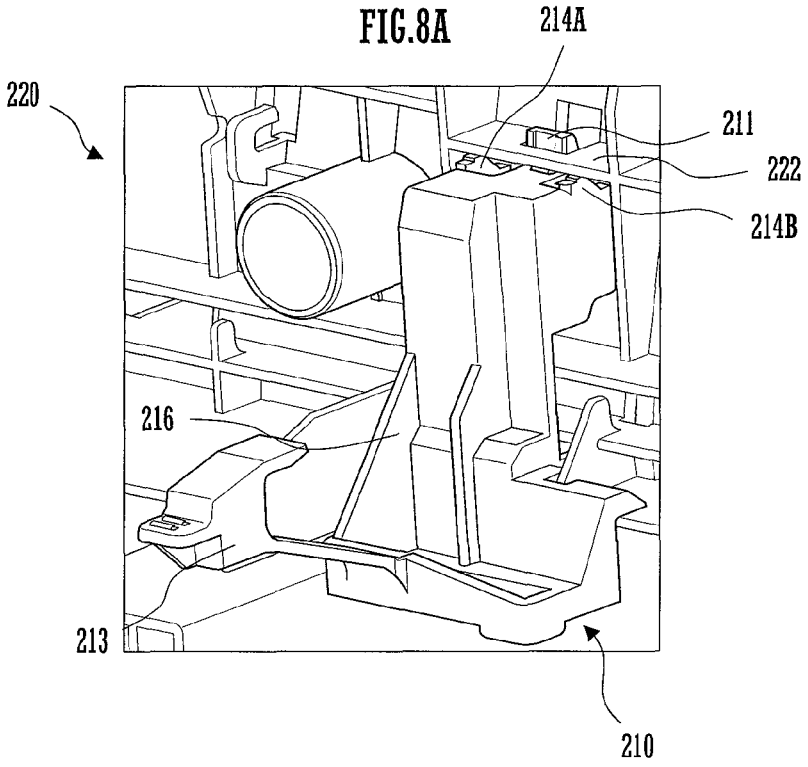
Figure 8B:
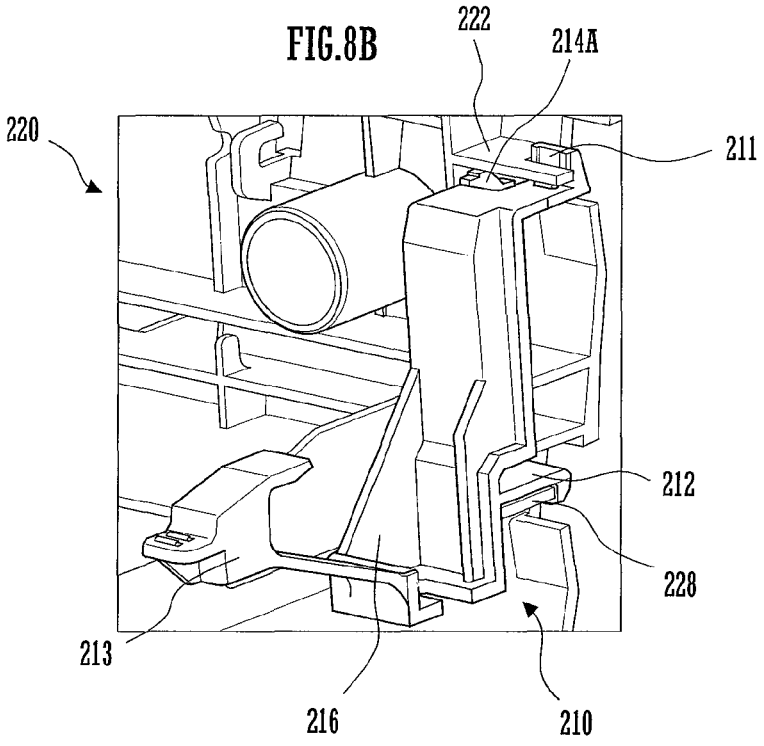
FIG. 8B is a perspective sectional view showing the state in which the second engaging section is brought into engagement with the second engagement section after the first engaging section having been brought into engagement with the first engagement section.

FIG. 7A shows a state in which the first engaging section 211 in the supporting member 210 is in engagement with the first engagement section 225, and FIG. 7B shows a cross sectional view of FIG. 7A to facilitate understanding of the state shown in FIG. 7A. FIG. 8A shows a state in which the supporting member 210 is mounted onto the engagement member 220, and FIG. 8B shows a cross sectional view of FIG. 8A to facilitate understanding of the state shown in FIG. 8A.

In the embodiment, the first engaging section 211 has a higher rigidity than the rib 222. Therefore, when the second engaging section 212 is to be brought into engagement with the second engagement section 229 in the second step after the first engagement section 211 having been brought into engagement with the first engagement section 225 in the first step as well, because the first engaging section 211 can expand the rib 222, the first engaging section 211 can be brought into in engagement with the engagement member 220 earlier than the second engaging section 212. That is to say, the rib 222 bends being pressed by the first engaging section 211 when the supporting member 210 is mounted onto the engagement member 220.

When the first engaging section 211 is brought into engagement with the first engagement section 225, the swing point (shaft) section 214 abuts against the rib 222. Subsequently, what is required in order to cause the second engaging section 212 to engage with the second engagement section 229 is to swing the supporting member 210 around the swing point (shaft) section 214 as a point of support for swing (a swing shaft), and then just to push the second engagement section 212 into the insertion hole 226. In the embodiment, the second engaging section 212 has a higher rigidity than the rib 228. Therefore, when the second engaging section 212 is pushed into the insertion hole 226, because the second engaging section 212 can expand the rib 228, the second engaging section 212 can be brought into in engagement with the second engagement section 229. That is to say, the rib 228 bends being pressed by the second engaging section 212 when the supporting member 210 is mounted onto the engagement member 220.

As shown in FIG. 7 and FIG. 8, by bringing the first engaging section 211 into engagement with the first engagement section 225, then swinging the supporting member 210 around the swing point (shaft) section 214 as a point of support for swing (a swing shaft), and then bringing the second engaging section 212 into engagement with the second engagement section 229, the supporting member 210 can be mounted onto the engagement member 220 with a natural force; so that workability in assembling is not lost.

Also, in the state in which the supporting member 210 is mounted onto the engagement member 220, the supporting member 210 can stably support or position a predetermined weighty object because its first engaging section 211 and its second engaging section 212 are respectively clamped by the rib 222 and the rib 228 in the engagement member 220.

Finally, the above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

What is claimed is:

1. A mounting structure comprising:

a supporting member having a first engaging section at one edge portion and a second engaging section at the other edge portion for supporting or positioning an object to support; and an engagement member for holding the supporting member with the supporting member being mounted onto the engagement member, the engagement member having a first engagement section capable of engaging with the first engaging section and a second engagement section capable of engaging with the second engaging section, wherein the mounting structure is configured such that the supporting member supports or positions the object to support with the first engaging section and the second engaging section respectively engaging with the first engagement section and the second engagement section;

that the first engaging section has a higher rigidity than the first engagement section;

that the second engaging section has a higher rigidity than the second engagement section; and that the supporting member is mounted onto the engagement member through a first step and a second step, wherein in the first step, the first engaging section engages with the first engagement section when the first engagement section is pressed by the first engaging section; and in the second step, the second engaging section engages with the second engagement section when the second engagement section is pressed by the second engaging section, and wherein the supporting member includes a handle section that is at right angle to a face of the engagement member in the state in which the supporting member is mounted onto the engagement member.

2. The mounting structure as claimed in claim 1, wherein the supporting member includes a hole to which the object to support is set.

3. A mounting structure comprising:

a supporting member having a first engaging section at one edge portion and a second engaging section at the other edge portion for supporting or positioning an object to support; and an engagement member for holding the supporting member with the supporting member being mounted onto the engagement member, the engagement member having a first engagement section capable of engaging with the first engaging section and a second engagement section capable of engaging with the second engaging section, wherein the mounting structure is configured such that the supporting member supports or positions the object to support with the first engaging section and the second engaging section respectively engaging with the first engagement section and the second engagement section;

that the first engaging section has a higher rigidity than the first engagement section;

that the second engaging section has a higher rigidity than the second engagement section; and that the supporting member is mounted onto the engagement member through a first step and a second step, wherein in the first step, the first engaging section engages with the first engagement section when the first engagement section is pressed by the first engaging section; and in the second step, the second engaging section engages with the second engagement section when the second engagement section is pressed by the second engaging section, and wherein the supporting member includes a rib formed on a rear face side of the supporting member.

4. The mounting structure as claimed in claim 3, wherein the supporting member includes a hole to which the object to support is set.

5. An image forming apparatus comprising:

a secondary transfer belt unit for transferring a toner image that is borne on an intermediate transfer belt onto a sheet; and a mounting structure that supports or positions the secondary transfer belt unit and that forms a sheet conveying path on a face on a side opposite to a side of a face on which the secondary transfer belt unit is mounted, the mounting structure comprising:

a supporting member having a first engaging section at one edge portion and a second engaging section at the other edge portion for supporting or positioning an object to support; and an engagement member for holding the supporting member with the supporting member being mounted onto the engagement member, the engagement member having a first engagement section capable of engaging with the first engaging section and a second engagement section capable of engaging with the second engaging section, wherein the mounting structure is configured such that the supporting member supports or positions the object to support with the first engaging section and the second engaging section respectively engaging with the first engagement section and the second engagement section;

that the first engaging section has a higher rigidity than the first engagement section;

that the second engaging section has a higher rigidity than the second engagement section; and that the supporting member is mounted onto the engagement member through a first step and a second step, wherein in the first step, the first engaging section engages with the first engagement section when the first engagement section is pressed by the first engaging section; and in the second step, the second engaging section engages with the second engagement section when the second engagement section is pressed by the second engaging section.

6. The mounting structure as claimed in claim 5, wherein the supporting member includes a hole to which the object to support is set.

* * * * *